United States Patent [19]

Hebel

[11] Patent Number: 4,811,597

[45] Date of Patent: Mar. 14, 1989

[54] WEIGHT-ON-BIT AND TORQUE MEASURING APPARATUS

[75] Inventor: James B. Hebel, Houston, Tex.

[73] Assignee: Smith International, Inc., Newport Beach, Calif.

[21] Appl. No.: 203,969

[22] Filed: Jun. 8, 1988

[51] Int. Cl.[4] ..... E21B 47/00

[52] U.S. Cl. ..... 73/151

[58] Field of Search ..... 73/151, 151.5, 152, 73/862.19; 166/250; 175/40

[56] References Cited

U.S. PATENT DOCUMENTS

| | | | |
|---|---|---|---|
| 3,686,942 | 8/1972 | Chatard et al. | 73/151 |
| 3,827,294 | 8/1974 | Anderson | 73/151 |
| 3,876,972 | 4/1975 | Garrett | 175/50 |
| 3,968,473 | 7/1976 | Patton et al. | 175/50 |
| 4,359,898 | 11/1982 | Tanguy et al. | 73/151 |
| 4,401,134 | 8/1983 | Dailey | 137/624.11 |
| 4,608,861 | 9/1986 | Wachtler et al. | 73/151 |
| 4,694,902 | 9/1987 | Hörmansdörfer | 73/151 |
| 4,760,735 | 8/1988 | Sheppard et al. | 73/151 |

*Primary Examiner*—Michael J. Tokar
*Assistant Examiner*—Kevin D. O'Shea
*Attorney, Agent, or Firm*—Robert M. Vargo

[57] ABSTRACT

A drill string sub is disclosed for measuring the torque and axial compression in the drill string. The drill string sub includes an outer tubular housing and an inner sleeve type apparatus mounted thereto for amplifying the strain the sensors measure. The sub further includes a section for compensating for the axial stresses due to the local pressure differential between the drill string bore and the well bore annulus and for the thermal gradients occurring during operation. This section includes a balance tube for isolating the internal bore pressure from acting on the strain amplifier and for creating an upward axial force on the tubular housing and strain amplifier which is responsive to this pressure differential to counter the axial stresses mentioned above. The sensors are encapsulated in oil to avoid the effects of the corrosion and electrical shorting which are promoted by drilling fluids.

31 Claims, 2 Drawing Sheets

WEIGHT-ON-BIT AND TORQUE MEASURING APPARATUS

BACKGROUND OF THE INVENTION

1. Field of the Invention

The present invention relates to downhole tools for sensing the stresses caused by torque and compression acting on the drill string, and for minimizing steady state errors due to pressure and temperature differences.

2. Description of the Prior Art

Weight-on-bit is generally recognized as being an important parameter in controlling the drilling of a well. Properly controlled weight-on-bit is necessary to optimize the rate that the bit penetrates the formation, as well a the bit wear.

Torque also is an important measure useful in estimating the wear of the bit, particularly when considered together with measurements of weight-on-bit. Excessive torque is indicative of serious bit damage such as bearing failure and locked cones.

In the past, weight-on-bit and torque measurements have been made at the surface. However, a surface measurement is not always reliable due to drag of the drill string on the borehole wall, and other factors.

Recent developments in borehole telemetry systems have made it possible to make the measurements downhole, but for the most part, the downhole sensors that have been utilized are subject to significant inaccuracies due to the effects of well pressures and temperature gradients that are present during the drilling process. These systems, regardless of the design of the sensing equipment cannot distinguish between strain due to weight and axial strain due to pressure differential "pump apart" force. This force may be defined as the force on the end area of a cylindrical pressure vessel such as an oil well drill pipe string which urges said vessel to elongate under internal pressure.

The problem that leads to the employment of a mechanical strain amplifier is that of obtaining a signal of satisfactory magnitude. Sensitive strain elements are subject to damage at high loads.

The first design adapted to this problem is described in U.S. Pat. No. 3,686,942. In that design the strain element is limber enough to give good signal response but the travel of its motion is constrained with stops to prevent inelastic deformation for loads well beyond the range of interesting measurements.

Another approach to this problem is shown in U.S. Pat. No. 3,968,473. This patent describes a tool having an inner mandrel with a thin section on which strain gages are glued and an outer stablizing sleeve. While there is no mechanical amplification in this design, the patent describes a mathematical sizing of the strain element so as to obtain matched sensitivity in the weight-on-bit and torque-on-bit modes at the maximum needed strength.

U.S. Pat. No. 3,827,294 shows a mechanical strain amplifier in a downhole tool which is geometrically dissimilar to the one disclosed in the present specification. Mechanical strain amplifiers are also shown in U.S. Pat. Nos. 3,876,972 and 4,608,861.

U.S. Pat. Nos. 4,359,898 and 3,968,473 illustrate designs utilizing pressure compensating devices, which, again, are dissimilar to the device disclosed in the present specification.

The current devices described above are deficient in at least one of the following features: automatic pressure compensation to correct for axial stress which is caused by "pump apart" tension; a means to prevent circumferential stress due to bore pressure from distorting the axial force bridge reading; and a means to avoid the effects of tool distortion due to temperature gradients.

SUMMARY OF THE INVENTION

The present invention obviates the above-mentioned shortcomings of the prior art by providing a downhole weight-on-bit and torque sensing tool that adequately compensates for the effects of pressure differential between the tool bore and the well bore annulus and for temperature gradients present during the drilling process. The means for compensating for the axial stresses due to the local pressure differential comprises a protective sleeve for isolating the internal bore pressure acting on a strain amplifier. This construction obviates the deleterious effect the internal bore pressure has on the strain sensors. The sleeve is also attached to a piston chamber which is adapted to apply a counter acting force through the sleeve to the strain amplifier, the amount of force being substantially equal to the "pump apart" force caused by the pressure differential between the drill string bore and the well bore annulus. As a result, the strain amplifier only senses the force due to the weight of the drill string acting on the tool. The sensors are also thermally and chemically isolated from the drilling fluid. This isolation is provided in order to prevent distortion on the strain amplifier due to temperature gradients, and to prevent corrosion and electrical shorting.

The general object of the present invention is to provide a new and improved apparatus for measuring weight-on-bit and torque downhole with high accuracy.

Another object of the present invention is to provide a sensor apparatus of the type described that employs strain gauges to measure axial and torsional forces on the bit in an improved manner.

This and other objects and advantages will be more evident in the detailed description given below.

DESCRIPTION OF THE PREFERRED EMBODIMENTS AND BEST MODE FOR CARRYING OUT THE INVENTION

Generally speaking, pressure pulses are transmitted through the drilling fluid used in the drilling operations to send information from the vicinity of the drill bit to the surface of the earth. As the well is drilled, at least one downhole condition, such as weight-on-bit or torque-on-bit, within the well is sensed, and a signal, usually analog, is generated to represent the sensed condition. The analog signal is converted to a digital signal, which is used to alter the flow of drilling fluid in the well to cause pulses at the surface to produce an appropriate signal representing the sensed downhole condition.

More specifically, a drill string is suspended in a borehole and has a typical drill bit attached to its lower end. Immediately above the bit is a sensor apparatus 10 constructed in accordance with the present invention. The output of the sensor 10 is fed to a transmitter, or pulser assembly, for example, of the type shown and described in U.S. Pat. No. 4,401,134 which is incorporated herein by reference. The pulser assembly is located and attached within a special drill collar section and is a hydraulically activated downhole regenerative pump. When initiated by a microprocessor, high pressure fluid hydraulically forces a poppet against an orifice and partially restricts the mud flow. The result is an increase in the circulating mud pressure which is observed as a positive pressure pulse at the earth's surface. This detected signal is then processed to provide recordable data representative of the downhole measurements. Although a pulsing system is mentioned herein, other types of telemetry systems may be employed, provided they are capable of transmitting an intelligible signal from downhole to the surface during the drilling operation.

Figure 1:
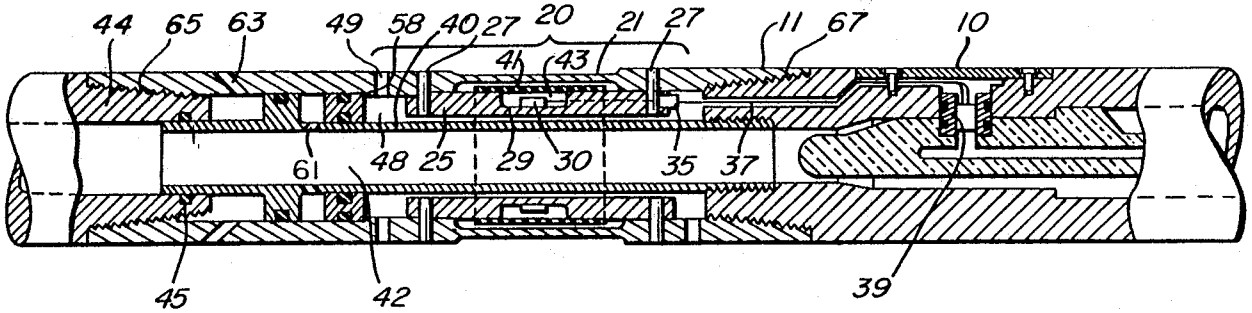
FIG. 1 is a sectional view of the downhole tool of the present invention.

Referring now to FIG. 1 for a detailed representation of a preferred embodiment of the present invention, the sensor apparatus 10 includes a tubular body 11 having a mechanical strain amplifier section 20 forming a portion of the tubular body 11. The strain amplifier section 20 comprises a primary cylindrical section 21 having an outside diameter on the exterior of the tubular body 11. Most of the stresses of torque and compression in the drill string are supported by the primary section 21.

A mechanical strain amplifier 25 is coaxially mounted within the primary section 21 and is coextensive therewith. The amplifier 25 is also formed as a cylindrical body that is affixed to the primary section by means of a plurality of pins 27 located at both ends thereof.

In the preferred embodiment, the strain amplifier section is removable so that all the electrical work can be done on the outside surface. This is accomplished by means of threaded connections 65 and 67 located on the ends of the tubular body 11 and the bottom sub 44.

The central portion of the amplifier 25 includes a reduced thickness section 29 having a plurality of electrical resistance-type strain gauges 30 mounted thereon. For measuring strain in the section 29 indicative of axial compression loading and torque acting on the body, preferably eight gauges 30 are arranged in four equally spaced rosettes about the periphery of the section 29 with each pair of opposed rosettes forming a bridge. Although not shown, each pair of opposed rosettes are utilized in a resistance bridge network of a general design familiar to those skilled in the art. Each pair of opposed rosettes forms a full bridge i.e., each resistive element of the wheatstone bridge is active. The bridge elements are cemented in place as two, two-gauge rosettes 180 degrees opposite each other on the O.D. of the strain amplifier 25. The set registering torque is placed 90 degrees away from the set registering weight-on-bit. Further, in terms of the orientation of the fibers of the resistive elements, the weight-on-bit rosettes are aligned in axial and transversal directions with respect to the drilling direction, while the torque rosettes are aligned diagonally (45 degrees away from the axial direction).

The electrical leads to the network are brought through appropriate sealed connectors and communicate with an electronics package via an electrical pass-through 35, a cable 37 which insulates, shields and excludes foreign substances, and an electrical pressure feed-through 39.

The region of space in which the strain gauges 30 are mounted is enclosed by a flexible rubber boot 41 and is filled with electrically inert transformer oil 43.

Also placed across the primary section 21 is a balance tube 40 for compensating for the axial stress which stems from the local pressure difference between the well bore annulus and the drill string bore. The balance tube 40 extends from the inside diameter of the tubular body 11 to the inside diameter of a bottom sub 44. Seals 45 are provided to seal off drill string bore 42 from the annular region between the outside of balance tube 40 and inside the outer wall of the tubular body 11. The upper portion of this area forms a compartment 48 which communicates through ports 49 to the exterior of the tubular body 11.

Figure 2:
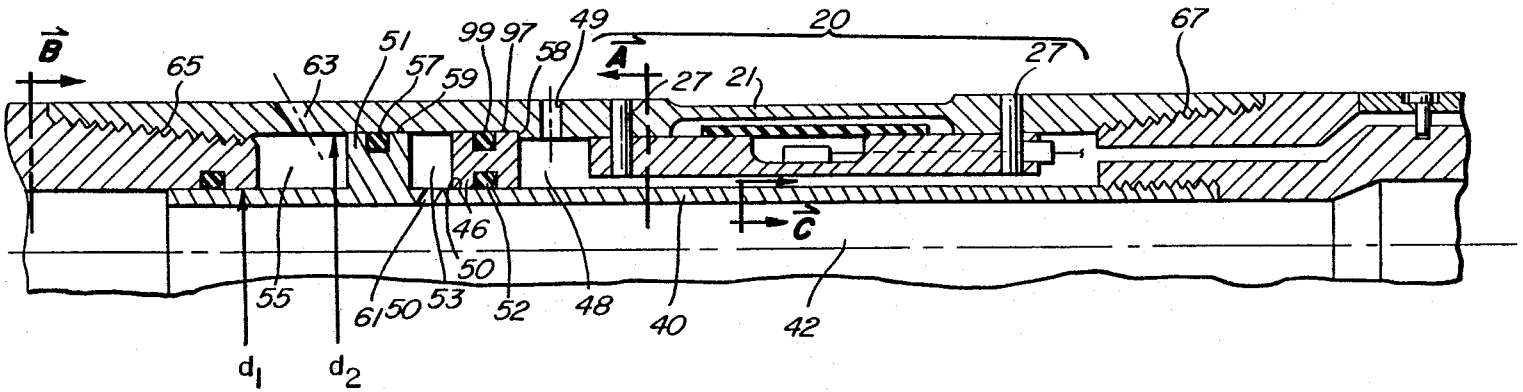
FIG. 2 is an enlarged view of a portion of the tool shown in FIG. 1.

FIG. 2 shows more clearly the balance tube 40 along with the amplifier section 20.

The lower end of the primary section 21 also includes a slidable piston 46 extending across the annulus and forms the lower end of compartment 48. A seal 52 is provided on the face 50 which abuts the balance tube 40. The face 97 of the out diameter at the piston 46 is sealed to the tubular body 11 by a seal 99. This slidable piston 46 is constrained from upper motion by shoulder 58 in the tubular body 11. The balance tube 40 also includes an annular projection 51 which extends across the same annulus to form two compartments 53 and 55. A seal 57 is provided on the face 59 of the projection 51. The compartment 53 communicates with the interior 42 of the balance tube 40 through port 61 while the compartment 55 communicates with the exterior of the tubular body 11 through port 63.

A primary advantage of the present invention is that the strained assembly is located in such a manner that it is subject only to the pressure and temperature of the well annulus yet chemically isolated from the well fluids.

In operation, the compensator system functions to eliminate the effect of the pressure differential between the tool bore and the downhole annulus acting on the strain amplifier 29. The changes in the strain gauges due to bulk stress are cancelled to a first order effect by the use of full bridge Wheatstone circuits. The balance tube 40 relieves the primary section 21 of extensive strains due to the pressure differential. This is accomplished by the slidable piston 46 and the annular projection 51 which, through its respective piston areas, are responsive to the differential pressures acting on compartments 48, 53 and 55 to exert an upward compressive force, on the primary member 21, and a reactive downward tensile force acting on the balance tube 40. In FIG. 2, the "pump apart" force exerts itself along the drill string, as for instance, at vector B and is a function of the local inside diameter and the local pressure. The local inside bore diameter shall be called $d_1$ and the resultant area A1. It should also be noted that the outer diameter of the piston area is $d_2$ with the resultant piston area noted as $A_2-A_1$ as previously mentioned, the "pump apart" force is the product of the pressure differential (delta p) times $A_1$. The projections 46 and 51 have their seal diameters chosen so that the force of delta p $(A_2-A_1)$ acts to compress the primary section 21 and strain amplifier 29, as for instance, at vector A, and as a reaction, to stretch the pressure balance tube 40 at vector C. Neglecting friction, $A_2-A_1=A_1$ will balance the forces. Hence ideally, the major diameter $d_2$ is the square root of two larger than the minor diameter $d_1$, i.e., $A_2$ equals twice $A_1$.

Regarding static seal friction acting on the components, laboratory testing has shown that when the seal area ratio was put at the ideal frictionless value of two, the compensation of "pump apart" force fell short by about ten percent for the test unit. However, using field test data, the geometric ratio of $A_2/A_1$ was altered from the ideal of two by an amount to overcome seal friction which was 2.15.

Figure 3:
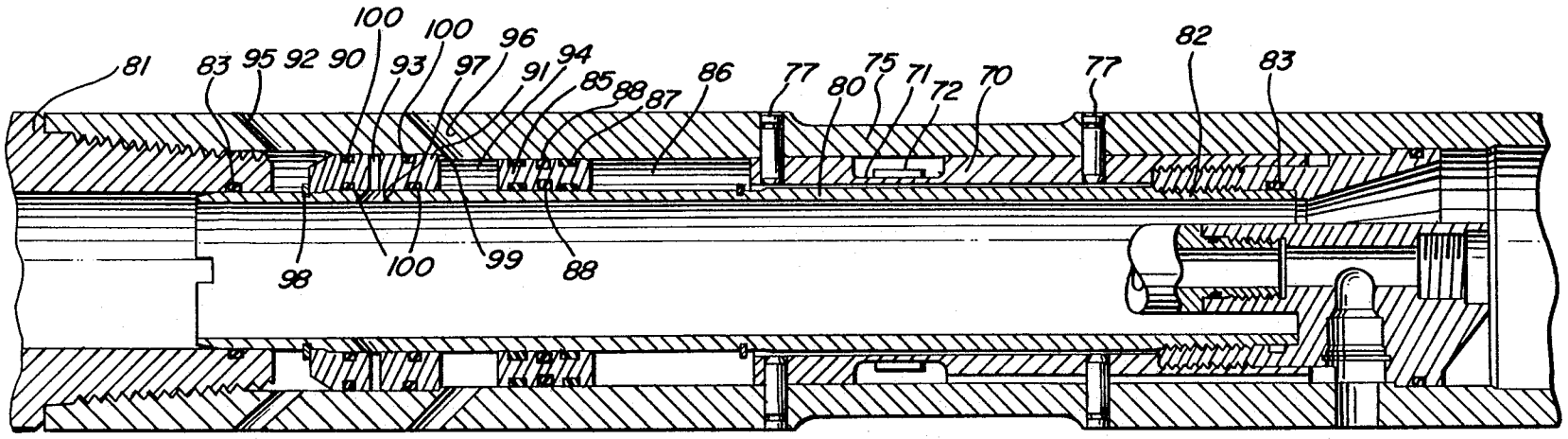
FIG. 3 is a sectional view of a second embodiment of the present invention.

Referring to FIG. 3, this embodiment shows a strain amplifier 70 having a reduced section 71 for supporting strain gauges 72 similar to those in the first embodiment. The strain amplifier 70 extends very closely along a primary member 75 and is connected thereto by pins 77. A balance tube 80 is threadedly supported by the drill string at its upper end 82, while its lower end extends into a connecting sub 81. The balance tube 80 is sealed at both ends by seals 83 and cooperated with the primary member 75 to form an enclosed chamber therebetween.

A sliding annular piston 85 is slidably located within this chamber to create seal compartment 86 for housing the strain amplifier 70. A quantity of electrical inert transformer oil is in the compartment 86 to completely fill up its volume.

Suitable annular anti-friction pads 87 and seals 88 are mounted on the sliding piston 85.

Second and third sliding pistons, 90 and 91 respectively, are also located with the compartment between the balance tube 80 and the primary member 75 to separate that volume into three compartments 92, 93 and 94. Compartments 92 and 94 are vented to the external fluid pressure by ports 95 and 96 while compartment 93 is vented to the internal fluid pressure by port 97. The lower end of piston 90 is adapted to abut a snap ring 98 to limit the piston's travel downwardly while the upper end of piston 91 is adapted to abut a shoulder 99 of the primary member 75. Suitable annular seals 100 are also located on the pistons 90 and 91.

It should be noted that the strain amplifier 70 is contiguous to the primary member 75 and spaced from the balance tube 80. This has been found to be sufficient to avoid the effects of tool distortion due to temperature gradients.

The sliding pistons 90 and 91 work in the same manner as the previous embodiment by functioning in response to the pressure differential in chambers 92, 93 and 94 to provide a compressive force to the primary member 75 and the strain amplifier 70 (via shoulder 99) and to provide a reactive tensile force to the balance tube 80.

Again, by having the piston area twice the bore area, the forces are balanced. As a result, the only force that the strain amplifier would see would be the compressive force of the drill column.

Moreover, similar compensations can be made for frictional drag of the seals 100 by making the piston area slightly larger than ideal.

Since certain other changes or modifications may be made by those skilled in the art without departing from the inventive concepts involved, it is the aim of the appended claims to cover all such changes and modifications falling within the true spirit and scope of the invention.

What is claimed is:

1. In a drill string assembly which is adapted to be utilized in a well bore, the assembly having a lower end which terminates with a rock bit for drilling the well bore, the assembly further having a plurality of drill pipes having an external cylindrical wall which cooperates with the well bore to form an outer well bore annulus, the inside of the drill pipes forming a drill string bore, a drill string sub adapted to be connected into the lower section of the drill string assembly, for measuring the weight and the torque acting on the rock bit, comprising;

a tubular housing having an outside diameter equal to the diameter of the drill string and an internal bore, said housing supporting the weight of said drill string assembly;

a strain amplifier comprising a uniform cylindrical section contiguous to said tubular housing and attached thereto to enable a portion of the support stresses to pass through said strain amplifier;

means mounted on said strain amplifier for sensing the stresses of torque and compression passing therethrough; and means for mechanically compensating for the axial stresses due to the local pressure differential between the drill string bore and the well bore annulus.

2. The invention of claim 1, wherein said compensating means comprises further means for isolating the internal bore pressure from acting on said strain amplifier and subjecting said strain amplifier only to the pressure of the well bore annulus.

3. The invention of claim 1, wherein said compensating means comprises means for creating an axial force on said tubular housing and said strain amplifier, the amount of said force being responsive to the pressure differential between the drill string bore and the well bore annulus.

4. The invention of claim 2, wherein said compensating means further comprises means for creating an axial force on said tubular housing and said strain amplifier, the amount of said force being responsive to the pressure differential between the drill string bore and the well bore annulus.

5. The invention of claim 3, wherein said strain amplifier includes a portion having a reduced wall thickness with respect to the rest of said cylindrical section.

6. The invention of claim 5 further including strain gauges mounted on said reduced wall portion.

7. The invention of claim 6 further comprising a cylindrical rubber boot mounted on the cylindrical wall of said strain amplifier and extending over said reduced wall portion to provide a sealed volume around said strain gauges.

8. The invention of claim 7, wherein said volume is filled with an electrically inert fluid.

9. The invention of claim 3, wherein said compensating means comprises a balance tube located between the inner side of said strain amplifier being coextensive therewith, said balance tube being attached at its upper end to said drill string sub.

10. The invention of claim 9, wherein said compensating means further comprises piston means located within a piston chamber, said piston means being engaged to said balance tube being and said tubular housing to apply axial forces thereto.

11. The invention of claim 10, wherein said piston chamber is formed by and between said tubular housing and said balance tube.

12. The invention of claim 11, wherein said piston means comprises two annular pistons separating said chamber into three compartments, the first annular piston engaging said balance tube, the second annular piston engaging said tubular housing.

13. The invention of claim 12, wherein the compartment between said annular pistons is in fluid communication via a port to said drill string bore, and the other two compartments are in fluid communication via ports to said well bore annulus.

14. The invention of claim 13, wherein said first annular piston is oriented below said second annular piston to apply a tensile axial force to said balance tube while said second annular piston applies a compressive axial force to said tubular housing.

15. The invention of claim 10, wherein said piston means has a face having an effective are which is substantially twice the area of the internal bore of said drill string sub.

16. The invention of claim 15, wherein piston area is substantially 2.15 times larger than said internal bore area.

17. The invention of claim 12, wherein said first piston comprises a projection extending from said balance tube across said chamber to slidingly engage the cylindrical wall of said tubular housing.

18. The invention of claim 17, wherein said second piston comprises a projection extending from said tubular housing across said chamber to slidingly engage the cylindrical wall of said balance tube.

19. The invention of claim 12, wherein said first piston slidingly engages the cylindrical walls of said balance tube and said tubular housing with said balance tube having a shoulder extending into said chamber for engagement with said first piston.

20. The invention of claim 19, wherein said second piston slidingly engages the cyclindrical walls of said balance tube and said tubular housing with said tubular housing having a shoulder extending into said chamber for engagement with said second piston.

21. The invention of claim 11, wherein the upper end of said piston chamber is formed by an annular piston slidingly mounted within said piston chamber.

22. The invention of claim 21 wherein the volume above said annular piston formed by said tubular housing and said balance tube is filled with electrically inert fluid.

23. In a drill string assembly which is adapted to be utilized in a well bore, the assembly having a lower end which terminates with a rock bit for drilling the well bore, the assembly further having a plurality of drill pipes having an external cylindrical wall which cooperates with the well bore to form an outer well bore annulus, the inside of the drill pipes forming a drill string bore, a drill string sub adapted to be connected into the lower section of the drill string assembly, for measuring the weight and the torque acting on the rock bit, comprising;

a tubular housing having an outside diameter equal to the diameter of the drill string and an internal bore, said housing supporting the weight of said drill string assembly;

means mounted on said tubular housing for sensing the stresses of torque and compression passing there through; and means for mechanically compensating for the axial stresses due to the local pressure differential between the drill string bore and the well bore annulus.

24. The invention of claim 23, wherein said compensating means comprises means for crating an axial force on said tubular housing, the amount of said force being responsive to the pressure differential between the drill string bore and the well bore annulus.

25. The invention of claim 24, wherein said compensating means comprises a balance tube located between the inner side of said strain amplifier being coextensive therewith, said balance tube being attached at its upper end to said drill string sub.

26. The invention of claim 25, wherein said compensating means further comprises piston means located within a piston chamber, said piston means being engaged to said balance tube being and said tubular housing to apply axial forces thereto.

27. The invention of claim 26, wherein said piston chamber is formed by and between said tubular housing and said balance tube.

28. The invention of claim 27, wherein said piston means comprises two annular pistons separating said chamber into three compartments, the first annular piston engaging said balance tube, the second annular piston engaging said tubular housing.

29. The invention of claim 28, wherein the compartment between said annular pistons is in fluid communication via a port to said drill string bore, and the other two compartments are in fluid communication via ports to said well bore annulus.

30. The invention of claim 29, wherein said first annular piston is oriented below said second annular piston to apply a tensile axial force to said balance tube while said second annular piston applies a compressive axial force to said tubular housing.

31. The invention of claim 26, wherein said piston means has a face having an effective area which is substantially twice the area of the internal bore of said drill string sub.

* * * * *